United States Patent [19]

Klapp

[11] 4,241,559

[45] Dec. 30, 1980

[54] LOWERING AND PIVOTING RAIL MECHANISM FOR A CARTON FILLING MACHINE

[75] Inventor: Hartmut Klapp, Kaarst, Fed. Rep. of Germany

[73] Assignee: Jagenberg Werke AG, Dusseldorf, Fed. Rep. of Germany

[21] Appl. No.: 22,138

[22] Filed: Mar. 20, 1979

[30] Foreign Application Priority Data

Jun. 12, 1978 [DE] Fed. Rep. of Germany ..... 2825648

[51] Int. Cl.[3] ..... B65B 5/10; B65H 29/14

[52] U.S. Cl. ..... 53/244; 53/534; 271/200; 271/214; 414/107

[58] Field of Search ..... 271/200, 201, 198, 184, 271/214, 191, 181; 53/542, 244, 259, 246, 248, 249, 250, 251, 505, 534; 93/93 DP, 93 HT; 198/604, 626, 607, 594, 812, 502; 414/107, 109, 110, 900

[56] References Cited

U.S. PATENT DOCUMENTS

| | | | |
|---|---|---|---|
| 1,603,294 | 10/1926 | Reiser | 271/181 |
| 3,019,581 | 2/1962 | Phillips et al. | 198/812 X |
| 3,147,846 | 9/1964 | Huntoon | 53/248 |
| 3,932,982 | 1/1976 | Klapp | 271/184 X |

*Primary Examiner*—Bruce H. Stoner, Jr.

*Attorney, Agent, or Firm*—Sughrue, Rothwell, Mion, Zinn and Macpeak

[57] ABSTRACT

The invention relates to a lowering and pivoting rail mechanism for a carton filling machine for guiding and loading blanks into transport containers, in which the lowering rail can be lowered more or less vertically to the vicinity of the floor of the transport container or to a previously loaded layer of blanks and in which the pivoting rail can be moved into a position above the layer of blanks to be loaded.

5 Claims, 1 Drawing Figure

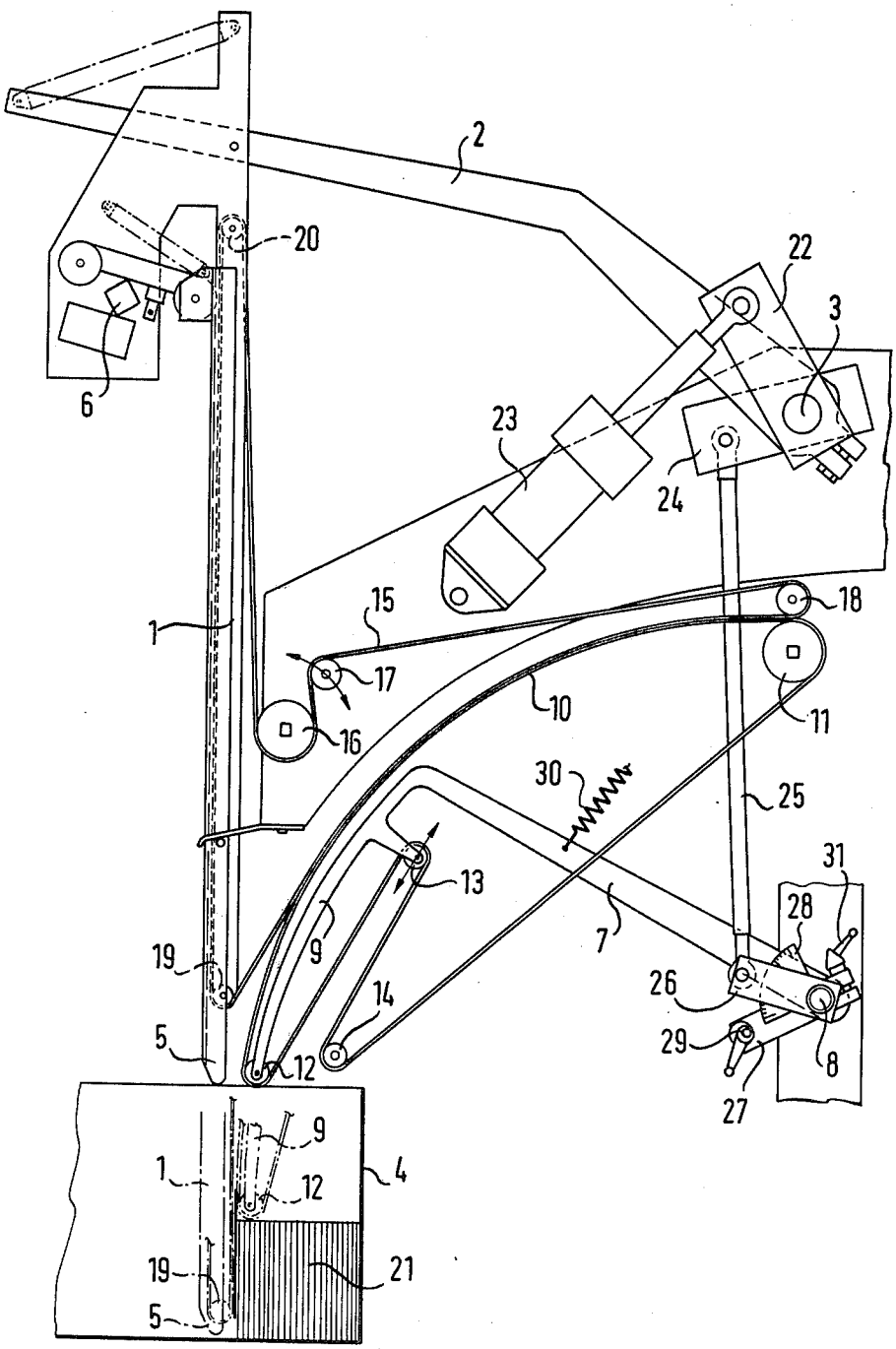
2
20
22
3
6
23
24
15
18
1
17
10
11
16
30
25
31
13
28
9
7
19
26
14
29
5
12
8
27
9
1
12
4
19
21
5

LOWERING AND PIVOTING RAIL MECHANISM FOR A CARTON FILLING MACHINE

BACKGROUND OF THE INVENTION

Lowering and pivoting rail mechanisms of this type are provided with belts for reliably guiding the blanks to a loading point. It is critical that when the lowering and pivoting rail mechanism is introduced into the transport container, the pivoting rail be stopped immediately above the loading point of the blanks while the lowering rail is lowered as far as possible in order to guide the blanks on at least one side as long as possible.

SUMMARY OF THE INVENTION

A basic object of the invention is the provision of a lowering and pivoting rail mechanism of the above-described type which provides a simple presetting of the lowering and pivoting rails in relation to each other according to the blanks to be loaded and which provides for reliable introduction of the preset lowering and pivoting rail mechanism into the transport container.

This object is achieved in accordance with the invention wherein a single drive is provided for the movement of the lowering rail and the pivoting rail. A lowering rail arm for the raising and lowering of the pivot rail and a pivoting rail arm for the pivoting of the pivoting rail are connected to each other by means of a connecting rod. The effective length of the connecting rod is adjustable in that an adjustable lost motion device is connected between the connecting rod and the pivoting rail arm.

For the single drive, a hydraulic cylinder is employed which is connected to the lowering rail arm. The lowering rail arm is connected to the connecting rod by means of a rigidly connected strap. The connecting rod is also connected to a stop plate which can be rotated about the point of rotation of the pivoting rail arm. The stop plate, in turn, rests against the cam of a wedge-like clamp bar in such a manner as to pivot the pivoting rail. This clamp bar is also adjustable with regard to the pivoting rail arm. This embodiment of the invention provides both simple and reliable preliminary setting of the positions of the lowering rail and pivoting rail within the transport container and reliable insertion and retraction of the entire lowering and pivoting rail mechanism.

Advantageously, the position of the clamp bar with regard to the pivoting rail arm can be adjusted according to a graduated dial located therebetween. A preliminary setting can be accomplished very simply and without prior knowledge of the correct setting particularly when the scale of the graduated dial corresponds to the height of the blanks or to the height of the blanks as compared to a predetermined value.

Finally, a spring is provided to bias the pivoting arm in the direction of the outwardly pivoted cleared position of the pivoting rail.

An exemplary embodiment of the invention is shown in the drawing and is described below in greater detail.

BRIEF DESCRIPTION OF THE DRAWING

The single illustration shows an embodiment of a lowering and pivoting rail mechanism according to the invention in side view.

DESCRIPTION OF THE PREFERRED EMBODIMENTS

The lowering and pivoting rail mechanism shown in the illustration has a lowering rail 1 which can be lowered in a basically vertical motion to the bottom of a carton 4 serving as a transport container with the aid of a lowering rail arm 2 which is pivotable about a bolt 3. In the drawing, the retracted position of the lowering rail 1 is shown. The broken lines indicate the lower portion of the lowering rail as inserted into carton 4. A switch rail 5 connected to an end switch 6 assures controlled introduction of lowering rail 1 into carton 4 until the bottom of carton 4 is almost reached.

A pivoting rail 9 is provided on a pivoting rail arm 7 which is pivotable about a bolt 8. Pivoting rail 9 is shown in the drawing in its retracted position with the front end of pivoting rail 9 shown by broken lines as inserted into carton 4.

A lower belt 10 runs around a drive roller 11 at the rear end of the pivoting rail 9 and around a first diverting roller 12 at the front end of pivoting rail 9 as well as around second and third diverting rollers 13 and 14. The blanks are delivered to the point of loading by means of lower belt 10.

An upper belt 15, which is driven by a drive roller 16, runs from drive roller 16 over a pivotable intermediate roller 17 to a fourth diverting roller 18 in the area of drive roller 11 and further along lower belt 10 to a fifth diverting roller 19 at the lower end of lowering rail 1. From there the upper belt is guided to a sixth diverting roller 20 at the upper end of lowering rail 1 and then back to drive roller 16. Upper belt 15 is provided for guiding blanks 21 delivered by lower belt 10 in the area between fourth diverting roller 18 and fifth diverting roller 19 and is solely responsible for the guiding thereof in the area between first diverting roller 12 when inserted into carton 4 and fifth diverting roller 19 when inserted to the loading position.

A strap 22 is rigidly connected to lowering rail arm 2 and is pivotable about the bolt 3. The free end of strap 22 is engaged by an hydraulic cylinder 23 which acts as a single drive to effect insertion into and retraction from the carton 4.

A further strap 24 is provided which is rigidly connected to lowering rail arm 2 and strap 22 and is also pivotable about the bolt 3. A connecting rod 25 is hinged to the free end of further strap 24. The other end of connecting rod 25 is hinged to a strap plate 26 which is pivotable about bolt 8. A wedge plate 27 is also pivotable about bolt 8 and is adjustably clamped to pivoting rail arm 7. A graduated dial 28 is provided between stop plate 26 and clamp bar 27 which is preferably calibrated in units corresponding to the blank height. A cam 29 is provided on the free end of the clamp bar 27 which provides for fine adjustment of the initial motion of lowering rail 1 and pivoting rail 9 relative to each other. Stop plate 26 strikes against cam 29 during the insertion movement of connecting rod 25. A spring 30 holds pivoting rail arm 7 in the retracted position after hydraulic cylinder 23 has completed retraction of the lowering rail 1.

After a clamping lever 31 is loosened when the lowering and pivoting rail mechanism is retracted, clamp bar 27 can be adjusted with regard to pivoting rail arm 7 in accordance with the setting of graduated dial 28. When the lowering and pivoting rail mechanism is inserted into the carton 4, stop plate 26 thus arrives at an accurately predetermined position in abutment with cam 29 on clamp bar 27. Thus, clamp bar 27 and thereby pivoting rail arm 7 together with the pivoting rail 9 arrive at an accurately predetermined position in carton 4 as shown by the broken lines in the drawing. The insertion of both the lowering rail as well as the pivoting rail is effected by hydraulic cylinder 23. The retraction of the lowering rail is also effected by hydraulic cylinder 23 while the retraction of pivoting rail 9 is effected by spring 30.

What is claimed is:

1. A lowering and pivoting rail mechanism for a carton filling machine including a lower belt supported by roller means fixed to a pivoting rail and an upper belt supported by roller means fixed to a lowering rail, blanks being guided between said upper and lower belts and loaded into transport containers in an upright position, in which said lowering rail can be lowered from a position above the container in a generally vertical direction to a point near one of the floor of the transport container and a point near a previously loaded layer of blanks, and the pivoting rail can be pivoted around a point of rotation from a retracted position to a position just above that of a loaded layer of blanks, comprising:

single drive means (23) for imparting motion to said lowering rail (1) and said pivoting rail (9);

a first arm (2) coupled to said lowering rail for raising and lowering it;

a second arm (7) coupled to said pivoting rail for pivoting it;

an adjustable lost motion mechanism (26-31) coupled to said second arm for providing a range of lost motion; and a connecting rod (25) coupling said first arm to said lost motion mechanism, whereby the amount of lost motion between said connecting rod and said second arm may be varied.

2. The rail mechanism according to claim 1, wherein: said single drive means comprises a hydraulic cylinder connected to said first arm; and further comprising:

a strap (24) rigidly connected to said connecting rod and to said first arm;

a clamp bar (27) rotatable about said point of rotation of said pivoting rail and adjustably clampable to said second arm, said clamp bar having a cam at its free end; and a stop plate (26) connected to said connecting rod, said stop plate being rotatable about said point of rotation of said pivoting rail and abutting against said cam for pivoting said pivoting rail.

3. The rail mechanism according to claim 2, further comprising a graduated dial (28) for indicating the degree of adjustment of the position of said clamp bar relative to said second arm, said graduated dial being disposed between said clamp bar and said pivoting rail arm.

4. The rail mechanism according to claim 3, wherein said graduated dial is calibrated in accordance with the height of the blanks to be loaded into said container in an upright position.

5. The rail mechanism according to any one of claims 1, 2, 3 or 4, further comprising a spring (30) for biasing said second arm in the direction of the retracted position of said pivoting rail.

* * * * *